US007338355B2

(12) United States Patent
Sanders, Jr. et al.

(10) Patent No.: US 7,338,355 B2
(45) **Date of Patent: *Mar. 4, 2008**

(54) ABRASIVE ARTICLE AND METHODS OF MAKING AND USING THE SAME

(75) Inventors: Rufus C. Sanders, Jr., Burnsville, MN (US); Timothy J. Rowell, St. Paul, MN (US); Satinder K. Nayar, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/423,829

(22) Filed: Jun. 13, 2006

(65) Prior Publication Data

US 2007/0287366 A1 Dec. 13, 2007

(51) Int. Cl.
*B24D 11/00* (2006.01)

(52) U.S. Cl. ..... 451/527; 451/533; 51/297

(58) Field of Classification Search ..... 451/526, 451/527, 532, 533, 537, 540, 245, 296, 297
See application file for complete search history.

(56) References Cited

U.S. PATENT DOCUMENTS

| | | | |
|---|---|---|---|
| 3,420,007 | A | 1/1969 | Kolesh |
| 3,594,863 | A | 7/1971 | Erb |
| 3,861,892 | A | 1/1975 | Wisdom, Jr. et al. |
| 3,932,966 | A | 1/1976 | Stern |
| 4,215,682 | A | 8/1980 | Kubik et al. |
| 4,282,011 | A | 8/1981 | Terpay |
| 4,287,685 | A | 9/1981 | Marton |
| RE30,782 | E | 10/1981 | van Turnhout |
| 4,374,888 | A | 2/1983 | Bornslaeger |
| RE31,285 | E | 6/1983 | van Turnhout et al. |
| 4,592,815 | A | 6/1986 | Nakao |
| 4,609,581 | A | 9/1986 | Ott |
| 4,668,558 | A | 5/1987 | Barber |
| 4,775,310 | A | 10/1988 | Fischer |
| 5,057,710 | A | 10/1991 | Nishiura et al. |
| 5,058,247 | A | 10/1991 | Thomas et al. |
| 5,059,277 | A | 10/1991 | Willhite, Jr. et al. |
| 5,069,403 | A | 12/1991 | Marentic et al. |
| 5,077,870 | A | 1/1992 | Melbye et al. |
| 5,131,924 | A | 7/1992 | Wiand |
| 5,133,516 | A | 7/1992 | Marentic et al. |
| 5,175,030 | A | 12/1992 | Lu et al. |

(Continued)

FOREIGN PATENT DOCUMENTS

| | | |
|---|---|---|
| CA | 2056812 | 3/1993 |

(Continued)

OTHER PUBLICATIONS

Design Application for An Abrasive Article With Holes, U.S. Appl. No. 29/253,085, filed Feb. 1. 2006.

(Continued)

*Primary Examiner*—Jacob K. Ackun, Jr.
(74) *Attorney, Agent, or Firm*—Bradford B. Wright

(57) ABSTRACT

An abrasive article having an apertured coated abrasive member, filter media, and an attachment interface member is formed by an ultrasonic welding process. The abrasive article is useful for abrading a workpiece.

21 Claims, 3 Drawing Sheets

U.S. PATENT DOCUMENTS

| | | | | |
|---|---|---|---|---|
| 5,306,545 | A | 4/1994 | Shirayanagi et al. | |
| 5,409,761 | A | 4/1995 | Langley | |
| 5,472,481 | A | 12/1995 | Jones et al. | |
| 5,490,878 | A | 2/1996 | Peterson et al. | |
| 5,496,507 | A | 3/1996 | Angadjivand et al. | |
| 5,514,120 | A | 5/1996 | Johnston et al. | |
| 5,691,846 | A | 11/1997 | Benson, Jr. et al. | |
| 5,900,305 | A | 5/1999 | Chapman | |
| 6,074,292 | A * | 6/2000 | Gilday | 451/533 |
| 6,077,601 | A | 6/2000 | DeVoe et al. | |
| 6,190,246 | B1 | 2/2001 | Parrott et al. | |
| 6,264,194 | B1 | 7/2001 | Hayashi et al. | |
| 6,267,832 | B1 | 7/2001 | Choi | |
| 6,280,824 | B1 | 8/2001 | Insley et al. | |
| 6,454,839 | B1 | 9/2002 | Hagglund et al. | |
| 6,482,308 | B1 | 11/2002 | Wiemann | |
| 6,511,566 | B1 | 1/2003 | Wessel et al. | |
| 6,521,067 | B1 | 2/2003 | Clark | |
| 6,575,821 | B2 | 6/2003 | Jöst | |
| 6,579,161 | B1 | 6/2003 | Chesley et al. | |
| 6,589,317 | B2 | 7/2003 | Zhang et al. | |
| 6,613,113 | B2 | 9/2003 | Minick et al. | |
| 6,773,527 | B2 | 8/2004 | Campbell et al. | |
| 6,790,126 | B2 * | 9/2004 | Wood et al. | 451/41 |
| 6,923,840 | B2 | 8/2005 | Schutz et al. | |
| 7,244,170 | B2 | 7/2007 | Woo et al. | |
| 7,252,694 | B2 | 8/2007 | Woo et al. | |
| 2001/0044006 | A1 | 11/2001 | Kruegler | |
| 2002/0016144 | A1 | 2/2002 | Jost | |
| 2003/0003856 | A1 | 1/2003 | Swei | |
| 2003/0127108 | A1 * | 7/2003 | Policicchio et al. | 134/6 |
| 2004/0098923 | A1 | 5/2004 | Hood et al. | |
| 2004/0166788 | A1 | 8/2004 | Travis | |
| 2004/0170801 | A1 | 9/2004 | Seth et al. | |
| 2004/0180618 | A1 | 9/2004 | Suzuki et al. | |
| 2005/0020190 | A1 | 1/2005 | Schutz et al. | |
| 2005/0133145 | A1 | 6/2005 | Blenke et al. | |
| 2005/0133146 | A1 | 6/2005 | Blenke et al. | |
| 2006/0019579 | A1 | 1/2006 | Braunschweig et al. | |
| 2006/0148390 | A1 | 7/2006 | Woo et al. | |
| 2006/0280908 | A1 | 12/2006 | Hoglund | |
| 2007/0028525 | A1 | 2/2007 | Woo et al. | |
| 2007/0066198 | A1 | 3/2007 | Rambosek et al. | |
| 2007/0066199 | A1 | 3/2007 | Woo et al. | |

FOREIGN PATENT DOCUMENTS

| | | |
|---|---|---|
| EP | 0 244 934 A2 | 11/1987 |
| EP | 0 738 562 A2 | 10/1996 |
| EP | 1 418 004 A2 | 5/2004 |
| EP | 1 488 888 A1 | 12/2004 |
| WO | WO 96/07509 | 3/1996 |

OTHER PUBLICATIONS

"Abrasive Article and Methods of Making Same", U.S. Appl. No. 11/229,281, filed Sep. 16, 2005.

"Abrasive Article Mounting Assembly and Methods of Making Same", U.S. Appl. No. 11/229,277, filed Sep. 16, 2005.

Woo et al., "Abrasive Article and Method of Making and Using the Same", U.S. Appl. No. 11/688,497, filed Mar. 20, 2007.

Woo et al., "Abrasive Article and Method of Making and Using the Same", U.S. Appl. No. 11/688,482, filed Mar. 20, 2007.

Rambosek et al., "Abrasive Article and Methods of Making the Same", U.S. Appl. No. 11/614,431, filed Dec. 21, 2006.

* cited by examiner

ABRASIVE ARTICLE AND METHODS OF MAKING AND USING THE SAME

BACKGROUND

Abrasive articles are used in industry for abrading, grinding, and polishing applications. They may be obtained in a variety of converted forms, such as belts, discs, sheets, and the like, in many different sizes.

Often, when using abrasives articles in the form of "sheet goods" (i.e., discs and sheets), a back-up pad is used to mount or attach the abrasive article to the abrading tool. One type of back-up pad has dust collection holes connected by a series of grooves. The dust collection holes are typically connected to a vacuum source to help control swarf build-up on the abrading surface of the abrasive article. Removing the swarf, dust, and debris from the abrading surface is known to improve the performance of the abrasive article.

Some abrasive tools have integral vacuum systems with dust collection means. The extracting and holding capabilities of these abrasive tools have been limited, in part, due to the suction requirements of current abrasive disks that their related back-up pads require.

In some abrasive tool configurations, swarf is collected in a complex dust collection system through a hose connected to the abrasive tools. Dust collection systems, however, are not always available for the abrasive tool operator. Further, the use of a dust collection system requires hoses that may be cumbersome and may interfere with the operator's manipulation of the abrasive tool.

There is a continuing need for alternative ways to provide an abrasive system with dust extraction capabilities.

SUMMARY

In one aspect, the present invention provides an abrasive article comprising:

an apertured coated abrasive member comprising abrasive particles secured to a first major surface of a thin flexible incompressible backing by make and size layers; and an adhesive layer adhered to a second major surface, opposite the first major surface, of the backing, wherein apertures extend through the abrasive layer, the backing, and the adhesive layer;

a first filter medium having a first surface and a second surface opposite the first surface, the first surface of the first filter medium adhered to the adhesive layer of the apertured coated abrasive member, the first filter medium defining discrete channels formed by channel sidewalls, the discrete channels extending from the first surface of the first filter medium to the second surface of the first filter medium;

a second filter medium having first and second opposed surfaces, wherein the first surface of the second filter medium is proximate the second surface of the first filter medium at an interface; and an attachment interface member affixed to the second surface of the second filter medium, wherein the attachment interface member comprises fabric and has a back surface proximate to the second filter medium and an outwardly disposed engageable surface opposed to the back surface;

wherein at least a portion of the apertures cooperate with at least a portion of the discrete channels to allow a flow of particles from the apertured coated abrasive member to the second filter medium, wherein the first filter medium, the second filter medium, and the attachment interface member are joined together by at least one weld situated at the interface.

Abrasive articles according to the present invention are useful, for example, for abrading a surface of a workpiece. Hence, in another aspect, the present invention provides a method of abrading a surface comprising frictionally contacting the surface with an abrasive article according to the present invention, and relatively moving the abrasive article and the surface to abrade the surface.

Abrasive article according to the present invention generally exhibit at least one improved abrading characteristic relative to corresponding abrasive articles having welds situated proximal to the coated abrasive member In another aspect, the present invention provides a method of making an abrasive article, the method comprising:

providing an apertured coated abrasive member comprising abrasive particles secured to a first major surface of a thin flexible incompressible backing by make and size layers; and an adhesive layer adhered to a second major surface, opposite the first major surface, of the backing, wherein apertures extend through the abrasive layer, the backing, and the adhesive layer;

providing a first filter medium having a first surface and a second surface opposite the first surface, the first filter medium defining discrete channels formed by channel sidewalls, the discrete channels extending from the first surface of the first filter medium to the second surface of the first filter medium;

providing a second filter medium having first and second opposed surfaces;

providing an attachment interface member comprising fabric and having a back surface and an engageable surface opposed to the back surface;

contacting the first surface of the second filter medium with the second surface of the first filter medium;

contacting the back surface of the attachment interface member and the second surface of the second filter medium;

forming at least one weld joining the first filter medium, the second filter medium, and the attachment interface member, wherein the weld is situated at the second surface of the first medium; and adhering the adhesive layer of the apertured coated abrasive member to the first surface of the first filter medium, wherein at least a portion of the apertures cooperate with at least a portion of the discrete channels to allow a flow of particles from the apertured coated abrasive member to the second filter medium.

In some embodiments, said at least one weld is formed by a process comprising:

contacting the first surface of the first filter medium with one of an ultrasonic welding horn or anvil, contacting the engageable surface of the attachment interface member with the other of the ultrasonic welding horn or anvil and ultrasonically forming at least one weld joining the first filter medium, the second filter medium, and the attachment interface member.

In some embodiments, the method further comprises bonding the first filter medium to the second filter medium prior to joining the first filter medium, the second filter medium, and the attachment interface member.

In some embodiments, the first filter medium, second filter medium, and the attachment interface member are joined together by a weld that comprises a continuous network of intersecting line segments. In some embodiments, the first filter medium, second filter medium, and the attachment interface member are joined together by at least 20 welds. In some embodiments, the welds have a maximum width in a range of from 1 to 10 millimeters. In some embodiments, the first filter medium has a maximum thickness in a range of 1 to 20 millimeters. In some embodiments, the channel sidewalls comprise polymer film, which may comprise a structured surface, and which may comprise an electrostatic charge. In some embodiments, the discrete channels comprise an average effective circular diameter of at least 0.1 millimeter. In some embodiments, the second filter medium comprises a nonwoven filter, which may comprise polyolefin fibers and have a basis weight in a range of 10 to 200 grams per square meter. In some embodiments, at least two of the apertured coated abrasive member, the first filter medium, the second filter medium, and the attachment interface member are coextensive. In some embodiments, the attachment interface member comprises pressure sensitive adhesive. In some embodiments, the fabric of the attachment interface member comprises polypropylene. In some embodiments, the attachment interface member comprises a loop portion or a hook portion of a two-part mechanical engagement system. In some embodiments, the abrasive article comprises an abrasive disk.

As used herein, the term "fabric" includes cloths and nets, which may be woven, nonwoven, knitted, or bonded;

"flexible" means capable of being flexed without permanent suffering physical damage;

"incompressible" means strongly resisting compression;

"thin" means relatively small in extent from one surface to an opposite surface; and "workpiece" means an object to be abraded such as, for example, wood, metal, dry wall, or a painted surface.

DETAILED DESCRIPTION

Figure 1A:
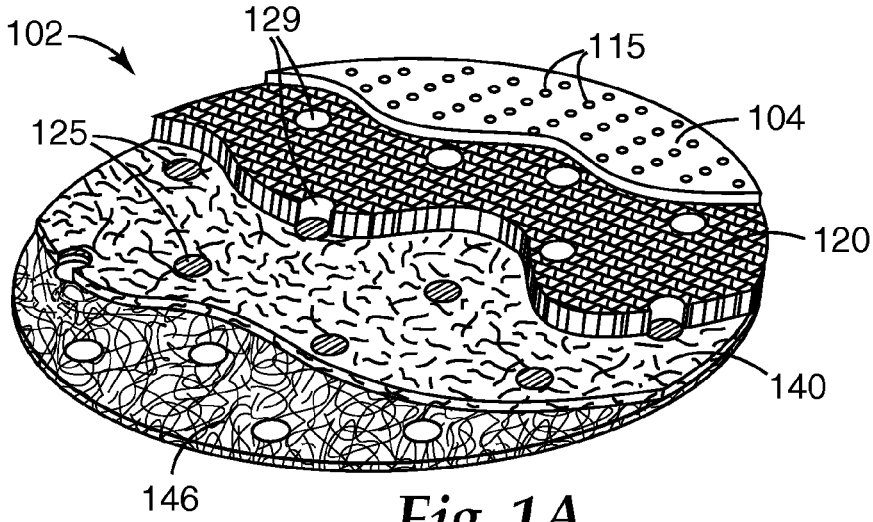
FIG. 1A is a perspective view of an exemplary abrasive article partially cut away to reveal the components forming the abrasive article.

FIG. 1A is a perspective view of an exemplary abrasive article 102 with a partial cutaway. As shown in FIG. 1A, abrasive article 102 has apertured coated abrasive member 104, first filter medium 120, second filter medium 140, and attachment interface member 146. First filter medium 120, second filter medium 140, and attachment interface member 146 are joined together by welds 125. As shown in this view, cavities 129 are formed in first filter medium 120, proximate to welds 125, during the ultrasonic welding process that is used to bond first filter medium 120, second filter medium 140, and an attachment interface member 146. Apertured coated abrasive member 104 has apertures 115 that, during abrading processes, allow the flow of detritus through apertured coated abrasive member 104. The particles are then captured by the filter media within the abrasive article.

Figure 1B:
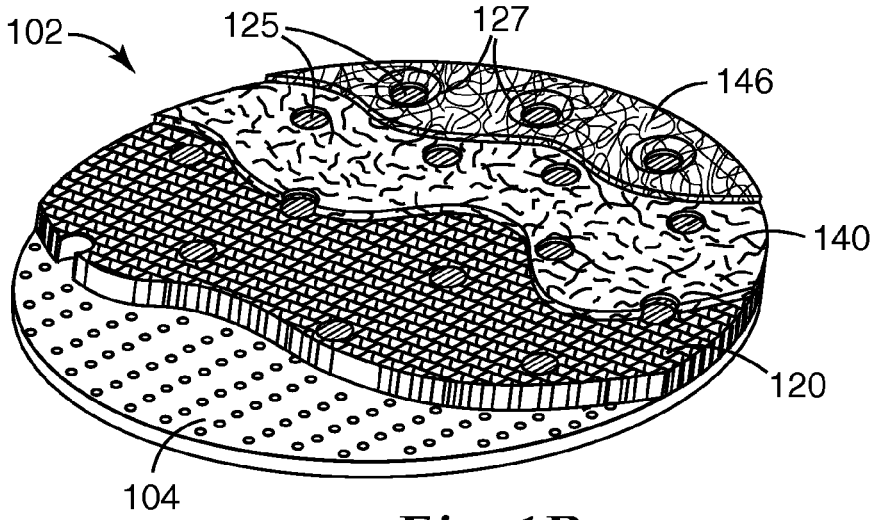
FIG. 1B is a perspective view of the exemplary abrasive article shown in FIG. 1A inverted in orientation and partially cut away to reveal the components forming the abrasive article.

An inverted perspective view of abrasive article 102 partially cut away to reveal the components of the abrasive article is shown in FIG. 1B. As shown in this view, puckers 127, proximate welds 125, are formed in second filter medium 140 and attachment interface member 146 during the ultrasonic welding process that is used to bond first filter medium 120, second filter medium 140, and an attachment interface member 146.

Figure 1C:
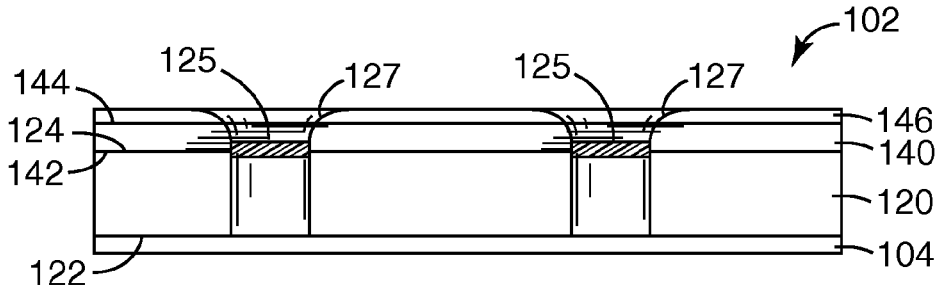
FIG. 1C is a schematic cross-sectional view of the exemplary abrasive article shown in FIG. 1B.

FIG. 1C shows a schematic cross-sectional view of abrasive article 102 (shown in FIG. 1B). As shown in FIG. 1C, abrasive article 102 comprises multiple layers. First filter medium 120 has first surface 122 and second surface 124 opposite first surface 122. Second filter medium 140 has first surface 142 and second surface 144 opposite first surface 142. First surface 122 of first filter medium 120 is proximate apertured coated abrasive member 104. Second surface 124 of first filter medium 120 is proximate first surface 142 of second filter medium 140. Attachment interface member 146 is affixed to second surface 144 of second filter medium 140. Welds 125 are situated at second surface 124 of first medium 120 and form the termini of puckers 127.

Figure 2:
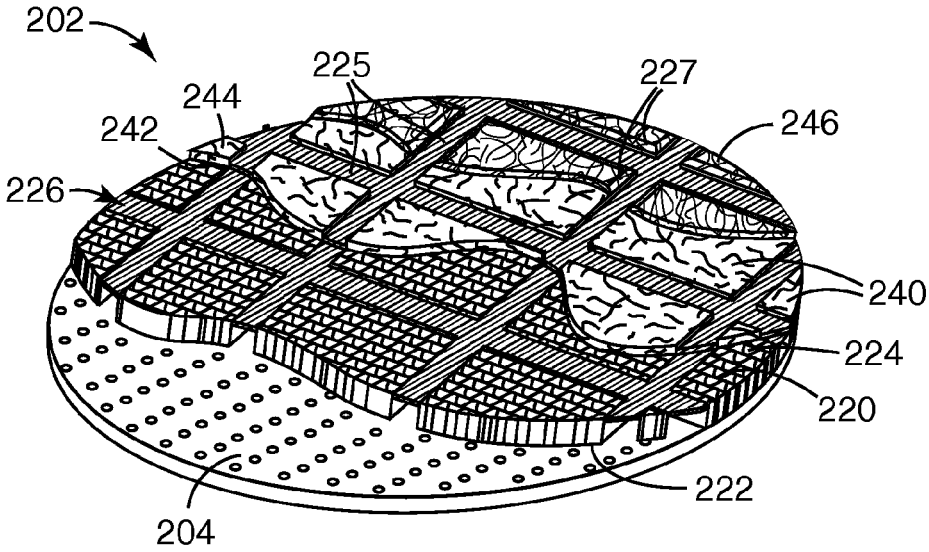
FIG. 2 is a perspective schematic view of an exemplary abrasive article partially cut away to reveal the components forming the abrasive article.

FIG. 2 shows another exemplary abrasive article 202. First filter medium 220 comprises first surface 222 and second surface 224 opposite first surface 222. Second filter medium 240 comprises first surface 242 and second surface 244 opposite first surface 242. First surface 222 of the first filter medium 220 is proximate apertured coated abrasive member 204. Second surface 224 of first filter medium 220 is proximate first surface 242 of second filter medium 240. Attachment interface member 246 is affixed to second surface 244 of second filter medium 240. Abrasive article 202 differs from abrasive article 102 (shown in FIGS. 1A and 2A), for example, in that a single weld 226 comprises a continuous network of intersecting line segments 225 situated along second surface 244. Weld 226 is situated at second surface 224 of first medium 220 and forms the terminus of puckers 227.

Typically, the weld(s), whether a plurality of discrete welds or a single weld comprising a continuous network of intersecting welded lines or line segments, either of which may be straight or curved, should be substantially evenly distributed across the second surface of the first filter medium in order to provide relatively uniform structural and performance characteristics across the abrasive article. This may be accomplished by a plurality of point welds or welds shaped as lines and/or line segments (i.e., relatively short welded lines), or by a welded continuous network of interconnected lines and/or line segments (e.g., a honeycomb pattern or a screen pattern). Thus, the density of welds is at least one and may be, for example, at least, 5, 10, 15, 20, 25, 30, 40, 50, or more per 30 square inches of the second surface of the first filter medium, with the actual number typically chosen such that adequate performance criteria (e.g., structural integrity or dust capacity) are met. Of course, larger abrasive articles will typically have more welds than smaller the The attachment interface member comprises fabric and may comprise, for example, a loop portion or a hook portion of a two-part mechanical engagement system. In some embodiments, the attachment interface member may comprise fabric with a layer of pressure sensitive adhesive thereon with an optional release liner to protect it during handling. Typically, the attachment interface member is porous and allows air to pass through, however this is not a requirement.

The attachment interface member may comprise a nonwoven, woven or knitted loop fabric, which may be used to affix the abrasive article to a back-up pad having a complementary mating component.

Woven and knit loop fabrics may have loop-forming filaments or yarns included in their fabric structure to form upstanding loops for engaging hooks. Nonwoven loop fabrics may have loops formed by the interlocking fibers. In some nonwoven loop attachment interface fabrics, the loops are formed by stitching a yarn through the nonwoven web to form upstanding loops.

Useful nonwovens suitable for use as looped fabrics include, for example, airlaid fabrics, spunbond fabrics, spunlaced fabrics, melt blown fabrics, and bonded carded webs. Nonwoven fabrics may be bonded in a variety of ways known to those skilled in the art including, for example, needle-punched, stitchbonded, hydroentangled, chemical bond, and thermal bond. The woven or nonwoven fabrics used may be made from natural fibers (e.g., wood or cotton fibers), synthetic fibers (e.g., polyester or polypropylene fibers) or combinations of natural and synthetic fibers. In some embodiments, the attachment interface member is made from nylon, polyester, polypropylene, or a combination thereof.

Loop fabrics may have an open structure that does not significantly interfere with the flow of air through it.

The attachment interface member may comprise a hook material, which may be made in one of many different ways known to those skilled in the art. Several suitable hook materials and processes for making them include, for example, those described in U.S. Pat. Nos. 5,058,247 (Thomas et al.) and 6,579,161 (Chesley et al.), and in U.S. Pat. Appln. Publ. No. 2004/0170801 A1 (Seth et al.), the disclosures of which are incorporated herein by reference.

The second filter medium may include a wide variety of types of apertured filter media conventionally used in filtration products, particularly air filtration products. For example, the second filter medium may be a fibrous material, foam, an apertured membrane, or the like. In some embodiments, the second filter medium comprises a fibrous material such as, for example, a fibrous filter web such as a nonwoven fibrous web, although woven and knitted webs may also be used.

In some embodiments, the second filter medium comprises fibrous materials having a fiber size that is less than about 100 microns in diameter, and sometimes less than about 50 microns, and sometimes less than about 1 micron in diameter. A wide variety of basis weights of the fibrous material may be used in the second filter medium. The basis weight of the second filter medium is typically in the range of about 5 grams per square meter to about 1000 grams per square meter. In some embodiments, the second filter medium is in the range of about 10 grams per square meter to about 200 grams per square meter. If desired, the second filter medium may include one or more layers (webs) of filter media.

The second filter medium may be made from a wide variety of organic polymeric materials, including mixtures and blends. Examples of suitable organic polymeric materials include a wide range of commercially available materials such as: polyolefins such as, for example, polypropylene, linear low density polyethylene, poly-1-butene, poly (4-methyl-1-pentene), polytetrafluoroethylene, polytrifluorochloroethylene, or polyvinyl chloride; aromatic polyarenes such as, for example, polystyrene; polycarbonates; polyesters such as, for example, polyethylene terephthalate or polylactic acid (PLA); and combinations thereof (including blends or copolymers). Useful polyolefins may be free of branched alkyl radicals. Other suitable materials include non-thermoplastic fibers such as cellulose, rayon, acrylic, and modified acrylic (halogen modified acrylic); polyamide or polyimide fibers such as those available under the trade designations "NOMEX" and "KEVLAR" from E. I. du Pont de Nemours and Co.; and combinations thereof.

In embodiments employing a nonwoven material as the second filter media, the nonwoven filter media may be formed in a web by conventional nonwoven techniques including melt blowing, spunbonding, carding, air laying (dry laying), wet laying, or the like. If desired, the fibers or webs may be charged by known methods, including, for example, by use of corona discharge electrodes or high-intensity electric fields. The fibers may be charged during fiber formation, prior to or while forming the fibers into the filter web or subsequent to forming the filter web. The fibers forming the second media filter may even be charged subsequent to being joined to the first filter media. The second filter media may comprise fibers coated with a polymer binder or adhesive, including pressure sensitive adhesives.

Figure 3A:
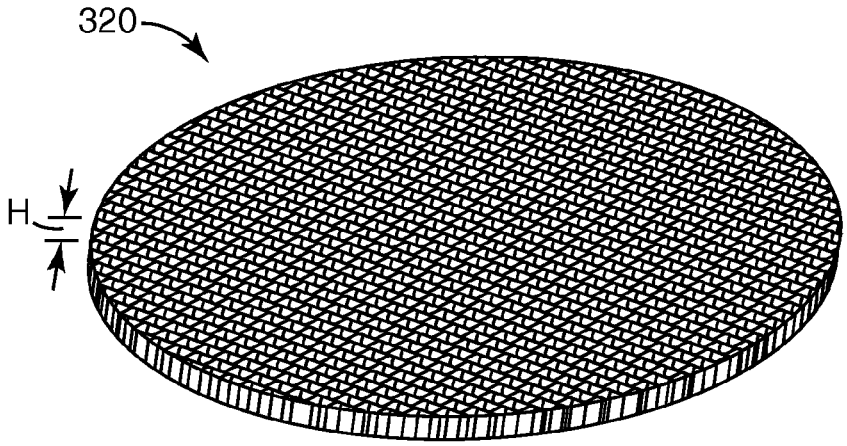
FIG. 3A is a perspective view of an exemplary first filter medium comprising stacked film layers.
Figure 3B:
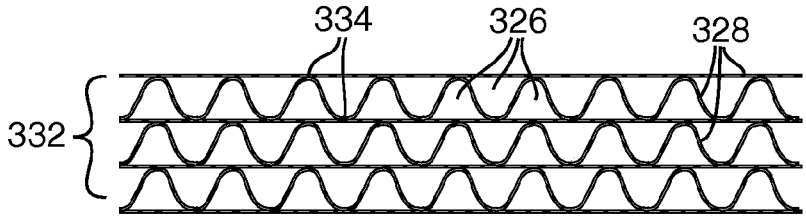
FIG. 3B is a top view of a portion of first filter medium shown in FIG. 3A.

FIG. 3A shows a perspective view of an exemplary first filter medium 320 comprising stacked film layers. FIG. 3B shows a top view of a portion of first filter medium 320 shown in FIG. 3A. As shown in FIG. 3A, first filter medium 320 has a thickness H that may be varied to accommodate varying applications. For example, if the particular abrading application demands an abrasive article with large particulate holding capacity, the thickness of the first filter medium may be increased. The thickness of the first filter medium may be defined by other parameters including, for example, the desired rigidity of the abrasive article. In some embodiments, the first filter medium of abrasive articles according to the present invention is relatively rigid in comparison to the other filter media used in the abrasive article.

The first filter medium typically has an average thickness of at least about 0.5 millimeter. In some embodiments, the first filter medium has an average thickness of at least about 1 millimeter. In yet further embodiments, the first filter medium has an average thickness of at least about 3 millimeters.

Typically, first filter medium has an average thickness that is less than about 30 millimeters. In some embodiments, the first filter medium has an average thickness that is less than about 20 millimeters. In yet further embodiments, the first filter medium has an average thickness that is less than about 10 millimeters.

As shown in FIG. 3B, exemplary first filter medium 320 comprises stack 332 of polymer films that form sidewalls 328 of channels 326 that extend through the thickness of first filter medium 320. The sidewalls 328 are held together at bond areas 334.

First filter medium that may be included in the abrasive article of abrasive articles according to the present invention include, for example, the filter media described in U.S. Pat. No. 6,280,824 (Insley et al.), U.S. Pat. No. 6,454,839 (Hagglund et al.), and U.S. Pat. No. 6,589,317 (Zhang et al.), the disclosures of which are incorporated herein by reference.

Polymers useful in forming the polymer film sidewalls of a first filter medium that may be used in the present invention include, but are not limited to, polyolefins such as polyethylene and polyethylene copolymers, polypropylene and polypropylene copolymers, polyvinylidene difluoride (PVDF), and polytetrafluoroethylene (PTFE). Other polymeric materials include acetates, cellulose ethers, polyvinyl alcohols, polysaccharides, polyesters, polyamides, poly(vinyl chloride), polyurethanes, polyureas, polycarbonates, and polystyrene. The polymer film layers may be cast from curable resin materials such as acrylates or epoxies and cured through free radical pathways promoted chemically, by exposure to heat, UV, or electron beam radiation. In some preferred embodiments, the polymer film layers are formed of polymeric material capable of being charged, namely, dielectric polymers and blends such as polyolefins or polystyrenes.

The polymer film layers may have structured surfaces defined on one or both faces as reported, for example, in U.S. Pat. No. 6,280,824 (Insley et al.), the disclosure of which is incorporated herein by reference. The structured surfaces may be in the shape of upstanding stems or projections, e.g., pyramids, cube corners, J-hooks, mushroom heads, or the like; continuous or intermittent ridges; e.g., rectangular or v-shaped ridges with intervening channels; or combinations thereof. These projections may be regular, random or intermittent or be combined with other structures such as ridges. The ridge-type structures may be regular, random intermittent, extend parallel to one another, or be at intersecting or nonintersecting angles and be combined with other structures between the ridges, such as nested ridges or projections. Generally, the high aspect ratio structures may extend over all or just a region of a film. When present in a film region, the structures provide a surface area greater than a corresponding planar film.

The structured surfaces may be made by any known method of forming a structured film such as the methods disclosed in U.S. Pat. Nos. 5,069,403 (Marantic et al.); 5,133,516 (Marantic et al.); 5,691,846 (Benson et al.); 5,514,120 (Johnston et al.); 5,175,030 (Lu et al.); 4,668,558 (Barber); 4,775,310 (Fisher); 3,594,863 (Erb) or 5,077,870 (Melbye et al.); the disclosures of which are incorporated herein by reference.

Figure 4:
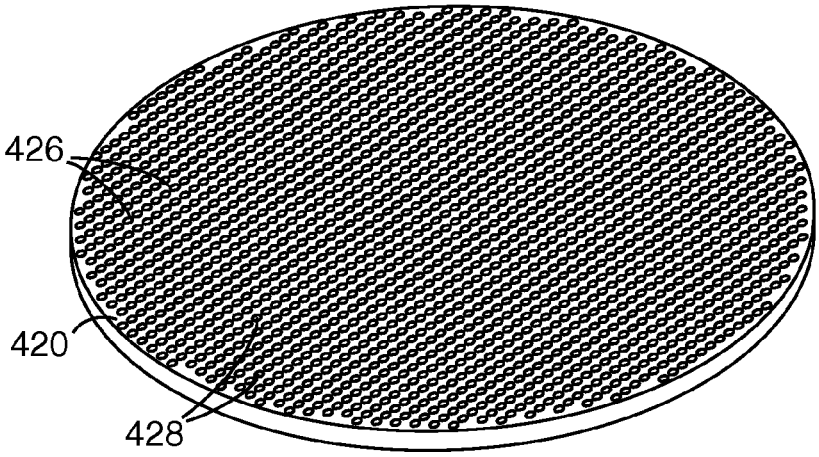
FIG. 4 is a perspective view of exemplary first filter medium comprising a perforated body.

FIG. 4 shows a perspective view of another exemplary first filter medium comprising a perforated body. As shown in FIG. 4, first filter medium 420 comprises channels 426 with channel sidewalls 428 extending from the first surface to the second surface of the first filter medium. The filter medium shown in FIG. 4 may be constructed from a variety of materials including, for example, foam, paper, or plastic, including molded thermoplastic materials and molded thermoset materials. In some embodiments, the first filter medium is made from perforated apertured foam material. In yet further embodiments, the first filter medium is made from perforated or slit and stretched sheet materials. In some embodiments utilizing a perforated body as a first filter medium, the perforated body is made from fiberglass, nylon, polyester, or polypropylene.

In some embodiments, the first filter medium has discrete channels that extend from the first surface to the second surface of the first filter medium. The channels may have a non-tortuous path that extends directly from the first surface to the second surface of the first filter medium. The cross-sectional area of the channels may be described in terms of an effective circular diameter, which is the diameter of the largest circle that will pass through an individual channel.

Typically, the first filter media have channels with an average effective circular diameter of at least about 0.1 millimeter, although this is not a requirement. In some embodiments, the first filter medium has channels with an average effective circular diameter of at least about 0.3 millimeters. In yet further embodiments, the first filter medium has channels with an average effective circular diameter of at least about 0.5 millimeters.

Typically, first filter medium has channels with an average effective circular diameter that is less than about 2 millimeters. In some embodiments, the first filter medium has channels with an average effective circular diameter that is less than about 1 millimeter. In yet further embodiments, the first filter medium have channels with an average effective circular diameter that is less than about 0.5 millimeters.

The filter media, including the first and second filter media, of abrasive articles according to the present invention may be electrostatically charged. Electrostatic charging enhances the filter media's ability to remove particulate matter from a fluid stream by increasing the attraction between particles and the surface of the filter media. Non-impinging particles passing close to sidewalls are more readily pulled from the fluid stream, and impinging particles are adhered more strongly. Passive electrostatic charging is provided by an electret, which is a dielectric material that exhibits an electrical charge that persists for extended time periods. Electret chargeable polymeric materials include nonpolar polymers such as polytetrafluoroethylene (PTFE) and polypropylene.

Several methods are used to charge dielectric materials, any of which may be used to charge the filtration media of the abrasive article of the present invention, including corona discharge, heating and cooling the material in the presence of a charged field, contact electrification, spraying the web with charged particles, and impinging a surface with water jets or water droplet streams. In addition, the chargeability of the surface may be enhanced by the use of blended materials. Examples of known charging methods include those disclosed in: U.S. Pat. No. RE30,782 (van Turnhout et al.), U.S. Pat. No. RE31,285 (van Turnhout et al.), U.S. Pat. No. 5,496,507 (Angadjivand et al.), U.S. Pat. No. 5,472,481 (Jones et al.), U.S. Pat. No. 4,215,682 (Kubik et al.), U.S. Pat. No. 5,057,710 (Nishiura et al.) and U.S. Pat. No. 4,592,815 (Nakao).

The first and second filter media may be bonded together prior to joining them to the attachment interface member. Useful bonding techniques include adhesives and ultrasonic welding.

Ultrasonic welding is a well-known technique that involves the use of high frequency sound energy to melt and fuse together materials to be welded. Ultrasonic welding equipment is widely commercially available. In an ultrasonic welding process, the pieces to be welded are held together under pressure between to elements commonly termed the "anvil" (a passive element) and "horn" (an ultrasonically vibrating element), and are then subject to ultrasonic vibrations, usually at a frequency of about 20 to about 40 kHz. Mechanical vibratory energy at an ultrasonic frequency is transferred from the welding horn to the compressed material thereby forming an ultrasonic weld. The horn and the anvil may have any shape. Typically, whichever of the horn or the anvil that has a smaller contact area will tend to penetrate the item to be welded more rapidly than the other. In such cases, it is typically useful to arrange the welding apparatus such that whichever of the horn or the anvil that has a smaller contact area contacts the first surface of the first filter medium during welding.

The time required to form the weld is typically less than one second, but will depend on factors such as the vibration amplitude, and the type of materials being welded. Further to the last point, ultrasonic welding is typically not effective with materials that cannot fuse together to form a weld. For this reason, at least a portion of the first filter medium, second filter medium, and the attachment interface member are typically selected such that they are of the same or similar materials that are melt compatible. For example, the first and second filter media may comprise polypropylene, while the attachment interface member comprises a fiber blend of nylon and polypropylene.

Once the first medium, second filter medium, and the attachment interface member have been welded together, an apertured coated abrasive member is adhered to the first filter medium by a layer of pressure sensitive adhesive.

Figure 5A:
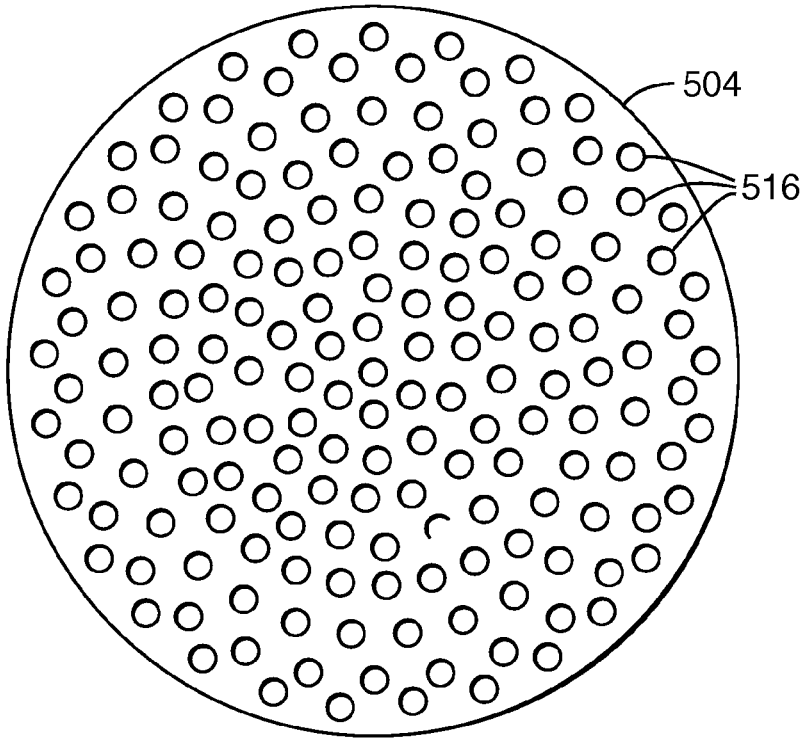
FIG. 5A is a top view of an exemplary apertured coated abrasive member.
Figure 5B:
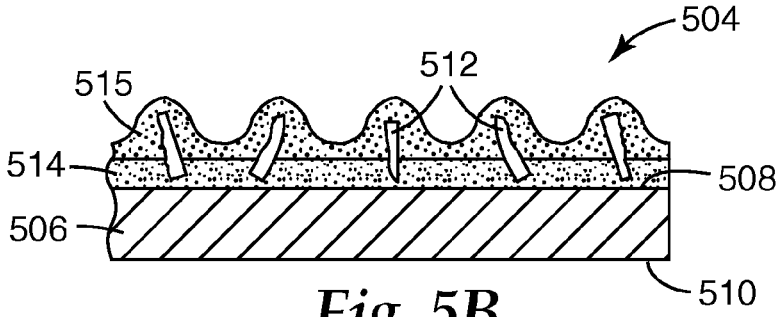
FIG. 5B is a cross-sectional view of a section of the apertured coated abrasive member shown in FIG. 5A.

FIG. 5A shows a top view of an exemplary apertured coated abrasive member 504. FIG. 5B shows a cross-sectional view of a section of apertured coated abrasive member 504 (shown in FIG. 5A). As shown in FIG. 5B, apertured coated abrasive member 504 comprises thin flexible incompressible backing 506 having first surface 508 and second surface 510, make coat 514, abrasive particles 512, and size coat 515. As shown in FIG. 5A, apertured coated abrasive member 504 comprises apertures 516 (not shown in FIG. 5B).

The thin flexible incompressible backing may be made from metal, paper, or plastic film (e.g., including for example thermoplastic materials such as polyester, polyethylene, and polypropylene).

Examples of commercially available apertured coated abrasive articles include material available under the trade designation "NORTON MULTI-AIR", from Saint-Gobain Abrasives GmbH, Wesseling, Germany, and coated abrasive discs available under the trade designation "360L MULTI-HOLE HOOKIT" from 3M Company, Saint Paul. Minn. Examples of commercially available coated abrasive articles that may be perforated (e.g., by a die or laser) to provide apertured coated abrasive articles include abrasive material available under the trade designation "373L MICRON MICROFINISHING FILM" from 3M Company.

It is presently discovered that the mode of carrying out the ultrasonic welding step influences the product performance of the resultant abrasive article. For example, if the anvil is placed against the first filter medium and the horn is placed against the attachment interface member, then weld(s) are typically formed at the first surface of the first filter medium, while if the horn is placed against the first filter medium and the anvil is placed against the attachment interface member, then weld(s) are typically formed at the second surface of the first filter medium.

Without wishing to be bound by theory, it is believed that the presence of relatively stiff welds at the first surface of the first medium and adhered to the thin flexible incompressible backing results in localized differences in abrasive properties of the apertured coated abrasive article that may result in a degree of reduction in abrasive properties such as, for example, cut. In addition, puckers formed if the weld(s) are situated at the first surface of the first filter medium are deeper than if the welds are situated at the first surface of the first filter medium, which may result in curving or warping of the overall abrasive article, again resulting in a degree of reduction in abrasive properties such as, for example, cut and or dust collection efficiency.

As discussed above, the apertured coated abrasive member comprises abrasive particles secured to the backing by make layer and size layers, and optionally a supersize layer. In some embodiments, a treatment may be applied to the substrate such as, for example, a presize, a backsize, a subsize, or a saturant.

Typically, the make layer of a coated abrasive is prepared by coating at least a portion of the substrate (treated or untreated) with a make layer precursor. Abrasive particles are then at least partially embedded (e.g., by electrostatic coating) to the make layer precursor comprising a first binder precursor, and the make layer precursor is at least partially cured. Electrostatic coating of the abrasive particles typically provides erectly oriented abrasive particles, wherein the term "erectly oriented" refers to a characteristic in which the longer dimensions of a majority of the abrasive particles are oriented substantially perpendicular (i.e., between 60 and 120 degrees) to the backing. Other techniques for erectly orienting abrasive particles may also be used.

Next, the size layer is prepared by coating at least a portion of the make layer and abrasive particles with a size layer precursor comprising a second binder precursor (which may be the same as, or different from, the first binder precursor), and at least partially curing the size layer precursor. In some coated abrasive articles, a supersize is applied to at least a portion of the size layer. If present, the supersize layer typically includes grinding aids and/or anti-loading materials.

Typically, make and size layers are formed by curing (e.g., by thermal means, or by using electromagnetic or particulate radiation) the corresponding make layer precursor and size layer precursor. Useful make layer and size layer precursors are well known in the abrasive art and include, for example, free-radically polymerizable monomer and/or oligomer, epoxy resins, acrylic resins, urethane resins, phenolic resins, urea-formaldehyde resins, melamine-formaldehyde resins, aminoplast resins, cyanate resins, or combinations thereof. Useful make layer and size layer precursors include thermally curable resins and radiation curable resins, which may be cured, for example, thermally and/or by exposure to radiation.

Suitable abrasive particles for the coated abrasives useful in the present invention may be any known abrasive particles or materials commonly used in abrasive articles. Examples of useful abrasive particles for coated abrasives include, for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

Abrasive particles according to the present invention may be used in a wide range of particle sizes, typically ranging in size from about 0.1 to about 5000 micrometers, more typically from about 1 to about 2000 micrometers; typically from about 5 to about 1500 micrometers, and more typically from about 10 to about 1500 micrometers. The abrasive particles are typically selected according to standard abrasives industry grading standards (e.g., ANSI, JIS or FEPA grades), although this is not a requirement. Abrasive particles graded according to industry accepted grading standards specify the particle size distribution for each nominal grade within numerical limits. Such industry accepted grading standards include those known as the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include P8, P12, P16, P24, P36, P40, P50, P60, P80, P100, P120, P150, P180, P220, P320, P400, P500, 600, P800, P1000, and P1200. Exemplary JIS grade designations include HS8, JIS12, JIS16, JIS24, JIS36, JIS46, JIS54, JIS60, JIS80, JIS100, JIS150, JIS180, JIS220, JIS 240, JIS280, JIS320, JIS360, JIS400, JIS400, JIS600, JIS800, JIS1000, JIS1500, JIS2500, JIS4000, JIS6000, JIS8000, and JIS10,000.

Advantages of the present invention are typically most evident when the abrasive particles have an average particle size of 50 micrometers or less; for example, 40 micrometers or less, or even 30 micrometers or less.

Useful apertured coated abrasives may further comprise optional additives such as abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are typically selected to provide the properties desired. Additives may also be incorporated into the binder, applied as a separate coating, held within the pores of the agglomerate, or combinations of the above.

The apertured coated abrasive member may comprise apertures having different open areas. The "open area" of an aperture refers to the area of the opening as measured over the thickness of the apertured coated abrasive member (i.e., the area bounded by the perimeter of material forming the opening through which a three-dimensional object could pass). Apertured abrasive layers useful in the present invention typically have an average open area of at least about 0.5 square millimeters per opening. In some embodiments, the apertured coated abrasive member has an average open area of at least about 1 square millimeter per opening; for example, the apertured coated abrasive member may have an average open area of at least about 1.5 square millimeters per opening. Typically, the apertured coated abrasive member has an average open area that is less than about 4 square millimeters per opening. In some embodiments, the apertured coated abrasive member has an average open area that is less than about 3 square millimeters per opening; for example, the apertured coated abrasive member has an average open area that is less than about 2.5 square millimeters per opening.

The apertured coated abrasive member, whether woven, perforated or otherwise, comprises a total open area that affects the amount of air that can pass through the apertured coated abrasive member as well as the effective area and performance of the abrasive member. The "total open area" of the apertured coated abrasive member refers to the cumulative open areas of the openings as measured over the area formed by the perimeter of the apertured coated abrasive member. Apertured abrasive members useful in the present invention have a total open area of at least about 0.01 square centimeters per square centimeter of the abrasive member (i.e., 1 percent open area). In some embodiments, the apertured coated abrasive member has a total open area of at least about 0.03 square centimeters per square centimeter of the abrasive member (i.e., 3 percent open area). In yet further embodiments, the apertured coated abrasive member has a total open area of at least about 0.05 square centimeters per square centimeter of the abrasive member (i.e., 5 percent open area).

Typically, apertured coated abrasive members have a total open area that is less than about 0.95 square centimeters per square centimeter of the abrasive member (i.e., 95 percent open area). In some embodiments, the apertured coated abrasive member has a total open area that is less than about 0.9 square centimeters per square centimeter of the abrasive member (i.e., 90 percent open area). In yet further embodiments, the apertured coated abrasive member has a total open area that is less than about 0.8 square centimeters per square centimeter of the abrasive member (i.e., 80 percent open area). The apertures may be arranged according to a pattern or in a random or pseudo-random manner.

The various layers in abrasive articles according to the present invention may be held together using any suitable form of attachment such as, for example, glue, pressure sensitive adhesive, hot-melt adhesive, spray adhesive, thermal bonding, and ultrasonic bonding. In some embodiments, some of the layers are adhered to one another by applying a spray adhesive such as, for example, that available under the trade designation "3M SUPER 77 ADHESIVE", available from 3M Company, St. Paul, Minn., to one side of the porous abrasive. In other embodiments, a hot-melt adhesive is applied to one side of a layer using either a hot-melt spray gun or an extruder with a comb-type shim. In yet further embodiments, a preformed adhesive mesh is placed between some of the layers to be joined.

The apertured coated abrasive member and various filter media layers of abrasive articles according to the present invention are affixed to one another in a manner that does not prevent the flow of particles from one layer to the next. In some embodiments, the apertured coated abrasive member and various filter media layers of abrasive articles according to the present invention are affixed to one another in a manner that does not substantially inhibit the flow of particles from one layer to the next. The level of particle flow through the abrasive article may be restricted, at least in part, by the introduction of an adhesive between the apertured coated abrasive member and the first filter medium, or the first filter medium and the second filter medium. The level of restriction may be minimized by applying the adhesive between layers in a discontinuous fashion such as for example, as discrete adhesive areas (e.g., atomized spray or starved extrusion die) or distinct adhesive lines (e.g., hot melt swirl-spray or patterned roll coater).

The attachment interface member of abrasive articles according to the present invention is affixed to the filter media in a manner that does not prevent the flow of air from the filter media. In some embodiments, the attachment interface member of abrasive articles according to the present invention is affixed to the filter media in a manner that does not substantially inhibit the flow of air from the filter media. The level of air flow through the attachment interface member may be restricted, at least in part, by the introduction of an adhesive between an attachment interface member comprising a sheet material and the filter media. The level of restriction may be minimized by applying the adhesive between the sheet material of the attachment interface member and the filter media in a discontinuous fashion such as, for example, discrete adhesive areas (e.g., atomized spray or starved extrusion die) or distinct adhesive lines (e.g., hot melt swirl-spray or patterned roll coater).

Adhesives useful in the present invention include both pressure sensitive and non-pressure sensitive adhesives. Pressure sensitive adhesives are normally tacky at room temperature and may be adhered to a surface by application of, at most, light finger pressure, while non-pressure sensitive adhesives include solvent, heat, or radiation activated adhesive systems. Examples of adhesives useful in the present invention include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; poly(alpha-olefin) polymers; amorphous polyolefins; silicone; ethylene-containing copolymers such as ethylene vinyl acetate, ethyl acrylate, and ethyl methacrylate; polyurethanes; polyamides; polyesters; epoxies; polyvinylpyrrolidone and vinylpyrrolidone copolymers; and mixtures of the above. Additionally, the adhesives may contain additives such as tackifiers, plasticizers, fillers, antioxidants, stabilizers, pigments, diffusing particles, curatives, and solvents.

Objects and advantages of this invention are further illustrated by the following non-limiting examples, but the particular materials and amounts thereof recited in these examples, as well as other conditions and, details, should not be construed to unduly limit this invention. Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used throughout the Examples:

| | |
|---|---|
| A1 | A coated abrasive material, commercially available under the trade designation "373L 30 MICRON MICROFINISHING FILM", from 3M Company, having laser perforated 4.57 millimeter diameter holes at a frequency of 1.37 holes per square centimeter. Prior to perforating, a 50% aqueous calcium stearate dispersion, commercially available under the trade designation "E-1058", from E-Chem, Leeds, England, was applied to the size layer and dried for 10 minutes at 120° F. (48.9° C.). The dry coating weight of calcium stearate in the supersize layer was 6.8 grams per square meter (g/m$^2$). |
| A2 | A coated abrasive material, commercially available under the trade designation "373L 50 MICRON MICROFINISHING FILM", from 3M Company, having laser perforated 4.57 millimeter diameter holes at a frequency of 1.37 holes per square centimeter. A supersize of calcium stearate of 6.8 g/m$^2$ was applied according to the same procedure as described in abrasive material A1. |
| A3 | A screen abrasive commercially available under the trade designation "ABRANET GRADE P600" from KWH Mirka Ltd., Jeppo, Finland. |
| A4 | A coated abrasive material, commercially available under the trade designation "373L 40 MICRON MICROFINISHING FILM", from 3M Company, having laser perforated 4.57 millimeter diameter holes at a frequency of 1.37 holes per square centimeter. |
| A5 | A nonwoven abrasive material, commercially available under the trade designation "07748 COLOR PREP SCUFF", from 3M Company, St. Paul, Minnesota. |
| A6 | A coated abrasive material as in "A5", with an addition layer of 5 mm thick bare polyurethane foam, 6 lb/ft$^3$ (0.1 gram/cm$^3$) density, commercially available under the trade designation "R600U" from Illbruck, Inc., Minneapolis, Minnesota. |
| F1 | 5 millimeter thick corrugated polypropylene multilayer filter media, commercially available under the trade designation "3M High Airflow Air Filtration Media (HAF)" from 3M Company. |
| F2 | An electrostatically charged staple fiber web, 100 gsm basis weight, with 2 percent of its overall surface area uniformly point bonded using ultrasonic welding, commercially available under the trade designation "FILTRETE G100" from 3M Company. |
| AT1 | A loop attachment material, commercially available under the trade designation "70 G/M$^2$ TRICOT DAYTONA BRUSHED NYLON LOOP FABRIC" from Sitip SpA, Genoa, Italy. |
| AT2 | A loop attachment material, obtained under the trade designation "85 G/M$^2$ TRICOT DAYTONA BRUSHED POLYPROPYLENE LOOP FABRIC" from Sitip SpA. |
| AT3 | A loop attachment material, obtained under the trade designation "110 G/M$^2$ TRICOT DAYTONA BRUSHED POLYPROPYLENE LOOP FABRIC" from Sitip SpA. |

Sample Preparation

The following abbreviations are used to describe the component layers used to assemble the abrasive article: L1—apertured coated abrasive member; L2—first filter medium proximate the apertured coated abrasive member; L3—filter media located between L2 and L4; and L4—attachment interface member.

Approximately 2.5 grams per square centimeter (g/cm$^2$) of adhesive, commercially available under the trade designation "HIGH STRENGTH 90 SPRAY ADHESIVE" from 3M Company, was applied to the non loop side of the attachment interface layer L4. A similar size sheet of filter media L3 was then laminated to the adhesive coated attachment interface material and allowed to dry. The same quantity of adhesive was then sprayed onto the surfaces between L2 and L3 and the filter media were laminated together and allowed to dry prior to the ultrasonic welding step.

Sanding Test

A 5-inch (12.7 centimeter (cm)) sample disc to be evaluated was attached to a 5-inch (12.7-cm) diameter by ⅜-inch (0.95 cm) thick foam backup pad, available under the trade designation "DYNABRADE BACK-UP PAD, MODEL 56320" from Dynabrade Corporation, Clarence, N.Y. The backup pad and disc assembly was weighed, then mounted onto a dual-action orbital sander, model "21038", also obtained from Dynabrade Corporation. The central dust extraction vacuum line was detached from the sander.

The abrasive face of the disc was automatically brought into contact with a pre-weighed 18-inch by 30-inch (45.7-cm by 76.2-cm) gel-coated fiberglass reinforced plastic panel, obtained from White Bear Boat Works, White Bear Lake, Minn. The sander was run at 91.5 pounds per square inch (630.9 kilopascals (kpa)) air line pressure and a down force of 15 pounds force (66.7 N)). An angle of zero degrees to the surface of the workpiece was used. Each test consisted of 24 or 48 overlapping transverse passes, 21 inches (53.3 cm) in length, resulting in an evenly sanded 18 by 26 inch (45.7 by 66.0 cm) area of test panel. Tool motion over the face of the panel was at a rate of 5 inches/second (12.7 cm/sec) for both X and Y directions. After the final sanding pass, the test panel and sample with backup pad were re-weighed. The test panel was then cleaned and weighed again. The sample was removed from the backup pad and the backup pad and tool were cleaned in preparation for another test.

The following measurements were made per each test and reported as an average:

"Cut": the weight, in grams, removed from the test panel.

"Retain": the weight, in grams, of swarf captured in the sample with Back-Up Pad "Surface": the weight, in grams, of swarf remaining on the test panel surface.

"Lost": the weight, in grams, of swarf that was unaccounted for and not contained in the values of "Retain" or "Surface".

"Capture Percent":the ratio of "Retain" to "Cut".

Comparative Example A

A laminate having filter materials F1, F2 and attachment material AT1, corresponding to layers L2, L3 and L4, respectively, was prepared according to the precursor bonding step described above. The laminate was then ultrasonically welded using a model "DUKANE 3000 AUTO TRAC 20 KHZ ULTRASONIC WELDER", obtained from Dukane Intelligent Assembly Solutions, St. Charles, Ill. Welding conditions were as follows:

| | |
|---|---|
| Weld Energy | 1,100 Joules |
| Trigger Force | 30 pounds-force (lbf) (133.5 Newtons (N)) |
| Weld Force | 460 lbf (2,046 N) |
| Horn Amplitude | 0.0014 inches (35.6 micrometers), peak to peak |
| Maximum Weld Time | 2.0 seconds |
| Hold Time | 1.0 second |
| Anvil | Multi 2.5 by 2.5 mm base by 6.4 mm height square steel posts |
| Horn | 5 × 5 inch (12.7 × 12.7 cm) aluminum block horn |
| Laminate Orientation | Horn adjacent to L2 |
| Weld Shape/Size | approximately 2.5 mm by 2.5 mm square |
| Weld Pattern | Uniformly distributed hexagonal array with 2.1 cm spacing, approximately 37 welds/disc |

Approximately 2.5 g/cm$^2$ of the spray adhesive was applied to the exposed face of the F1, to which a similar size sheet of porous abrasive material A2 was laminated. After drying for 2 hours at 25° C., 5-inch (13-cm) abrasive discs were then die-cut from the ultrasonically welded laminate and subjected to 24 and 48 passes of the sanding test.

Comparative Example B

Abrasive discs were prepared according to the method described in Comparative A, except abrasive material A3 was used instead of A2.

Example 1

Abrasive discs were prepared according to the method described in Comparative A, except attachment material AT3 was used instead of AT1, and the welding orientation was reversed.

Example 2

Abrasive discs were prepared according to the method described in Example B, except the welding orientation was reversed.

Results of evaluating Comparative Examples A-B and examples 1-2 are reported in Table 1 (below).

TABLE 1

| Example | No. Of Sanding Passes | FILTER-ABRASIVE LAMINATE L1 | L2 | L3 | L4 | CUT, grams | RETAIN, grams |
|---|---|---|---|---|---|---|---|
| Comparative Example A | 24 | A1 | F1 | F2 | AT2 | 2.65, 2.86, 2.81 | 2.53, 2.71, 2.67 |
| Average | | | | | | 2.77 | 2.63 |
| Example 1 | 24 | A1 | F1 | F2 | AT3 | 2.97, 3.00, 3.14 | 2.77, 2.8, 2.99 |
| Average | | | | | | 3.03 | 2.85 |
| Comparative Example A | 48 | A1 | F1 | F2 | AT2 | 4.83, 4.87, 4.63 | 4.54, 4.56, 4.33 |
| Average | | | | | | 4.78 | 4.47 |
| Example 1 | 48 | A1 | F1 | F2 | AT3 | 4.85, 4.57, 5.33 | 4.40, 4.16, 4.98 |
| Average | | | | | | 4.92 | 4.51 |
| Comparative Example B | 24 | A2 | F1 | F2 | AT3 | 6.26,5.72, 6.97, 6.46 | 5.92, 6.00 |
| Average | | | | | | 6.56 | 5.82 |
| Example 2 | 24 | A2 | F1 | F2 | AT3 | 7.00, 6.88, 6.86 | 6.45, 6.45, 6.37 |
| Average | | | | | | 6.91 | 6.42 |
| Comparative Example B | 48 | A2 | F1 | F2 | AT3 | 10.30, 11.94, 11.37 | 8.08, 7.86, 8.11 |
| Average | | | | | | 11.20 | 8.01 |
| Example 2 | 48 | A2 | F1 | F2 | AT3 | 12.02, 11.27, 11.72 | 9.33, 9.73, 9.40 |
| Average | | | | | | 11.67 | 9.48 |

Comparative Example C

Abrasive discs were prepared according to the method described in Comparative Example A, except A4 was used as the abrasive material.

Comparative Example D

Abrasive discs were prepared according to the method described in Comparative Example C, except AT3 was used as the attachment material Example 3

Abrasive discs were prepared according to the method described in Comparative Example C, except the welding orientation was reversed.

Example 4

Abrasive discs were prepared according to the method described in Example D except the welding orientation was reversed.

Results reported in Table 2 (below) represent sanding test data for six replicates, 48 passes per test.

TABLE 2

| | FILTER-ABRASIVE LAMINATE | | | | CUT, | RETAIN, |
|---|---|---|---|---|---|---|
| | L1 | L2 | L3 | L4 | grams | grams |
| Comparative Example C | A4 | F1 | F2 | AT2 | 10.14, | 7.04, |
| | | | | | 9.25, | 7.26, |
| | | | | | 10.80, | 7.71, |
| | | | | | 10.89, | 7.54, |
| | | | | | 8.95, | 6.26, |
| | | | | | 10.52 | 7.35 |
| Average | | | | | 10.09 | 7.19 |
| Example 3 | A4 | F1 | F2 | AT2 | 10.49, | 8.01, |
| | | | | | 10.77, | 8.82, |
| | | | | | 10.67, | 8.50, |
| | | | | | 7.51, | 6.85, |
| | | | | | 10.84, | 8.53, |
| | | | | | 10.35 | 8.80 |
| Average | | | | | 10.11 | 8.25 |
| Comparative Example D | A4 | F1 | F2 | AT3 | 9.51, | 7.52, |
| | | | | | 9.01, | 7.31, |
| | | | | | 9.25, | 6.74, |
| | | | | | 8.68, | 7.21, |
| | | | | | 10.04, | 7.77, |
| | | | | | 9.21 | 7.62 |
| Average | | | | | 9.28 | 7.36 |
| Example 4 | A4 | F1 | F2 | AT3 | 10.34, | 8.73, |
| | | | | | 10.74, | 8.40, |
| | | | | | 8.71, | 7.86, |
| | | | | | 9.75, | 8.04, |
| | | | | | 9.63, | 8.28, |
| | | | | | 8.45 | 5.78 |
| Average | | | | | 9.60 | 7.85 |

Comparative Examples E and F

Abrasive discs were prepared according to the method described in Comparative Examples A and Example 3, corresponding to Comparatives E and F, respectively, except that A5 was used as the abrasive material. Results reported in Table 4 represent sanding data for 48 passes per test.

Comparative Examples G and H

Abrasive discs were prepared according to the method described in Comparative Examples A and Example 3, corresponding to Comparatives G and H, respectively, except that A3 was used as the abrasive material. Results reported in Table 4 represent sanding data for 48 passes per test.

Comparative Examples I and J

Abrasive discs were prepared according to the method described in Comparative Examples A and Example 4, corresponding to Comparatives I and J, respectively, except that A6 was used as the abrasive material.

Results reported in Table 3 (below) represent Sanding Test data for 48 passes per test.

TABLE 3

| | FILTER-ABRASIVE LAMINATE | | | | CUT, | RETAIN, |
|---|---|---|---|---|---|---|
| | L1 | L2 | L3 | L4 | grams | grams |
| Comparative Example E | A5 | F1 | F2 | AT2 | 0.22 | 0.14 |
| Comparative Example F | A5 | F1 | F2 | AT2 | 0.21 | 0.20 |
| Comparative Example G | A4 | F1 | F2 | AT2 | 3.46 | 3.40 |
| Comparative Example H | A4 | F1 | F2 | AT2 | 2.78 | 2.75 |
| Comparative Example I | A6 | F1 | F2 | AT2 | 3.30 | 3.22 |
| Comparative Example J | A6 | F1 | F2 | AT2 | 3.04 | 2.99 |

Various modifications and alterations of this invention may be made by those skilled in the art without departing from the scope and spirit of this invention, and it should be understood that this invention is not to be unduly limited to the illustrative embodiments set forth herein.

What is claimed is:

1. An abrasive article comprising:

an apertured coated abrasive member comprising abrasive particles secured to a first major surface of a thin flexible incompressible backing by make and size layers; and an adhesive layer adhered to a second major surface, opposite the first major surface, of the backing, wherein apertures extend through the abrasive layer, the backing, and the adhesive layer;

a first filter medium having a first surface and a second surface opposite the first surface, the first surface of the first filter medium adhered to the adhesive layer of the apertured coated abrasive member, the first filter medium defining discrete channels formed by channel sidewalls, the discrete channels extending from the first surface of the first filter medium to the second surface of the first filter medium;

a second filter medium having first and second opposed surfaces, wherein the first surface of the second filter medium is proximate the second surface of the first filter medium at an interface; and an attachment interface member affixed to the second surface of the second filter medium, wherein the attachment interface member comprises fabric and has a back surface proximate to the second filter medium and an outwardly disposed engageable surface opposed to the back surface;

wherein at least a portion of the apertures cooperate with at least a portion of the discrete channels to allow a flow of particles from the apertured coated abrasive member to the second filter medium, wherein the first filter medium, the second filter medium, and the attachment interface member are joined together by at least one weld situated at the interface.

2. An abrasive article according to claim 1, wherein the first filter medium, the second filter medium, and the attachment interface member are joined together by a weld that comprises a continuous network of intersecting lines or line segments.

3. An abrasive article according to claim 1, wherein the first filter medium, the second filter medium, and the attachment interface member are joined together by at least 20 welds.

4. An abrasive article according to claim 1, wherein the welds have a maximum width in a range of from 1 to 10 millimeters.

5. An abrasive article according to claim 1, wherein the first filter medium has a maximum thickness in a range of 1 to 20 millimeters.

6. An abrasive article according to claim 1, wherein the channel sidewalls comprise polymer film.

7. An abrasive article according to claim 1, wherein the discrete channels have an average effective circular diameter of at least 0.1 millimeter.

8. An abrasive article according to claim 1, wherein the second filter medium comprises a nonwoven filter.

9. An abrasive article according to claim 1, wherein at least one of the first filter medium or the second filter medium has an electret charge.

10. An abrasive article according to claim 1, wherein the attachment interface member comprises a loop portion of a two-part mechanical engagement system.

11. An abrasive article according to claim 1, wherein the first filter medium, second filter medium, and attachment interface member each comprise polypropylene.

12. An abrasive article according to claim 1, wherein the abrasive article comprises an abrasive disk.

13. An abrasive article according to claim 1, wherein the abrasive particles have an average particle size of 50 micrometers or less.

14. A method of abrading a surface of a workpiece comprising frictionally contacting the surface of the workpiece with an abrasive article according to claim 1, and relatively moving the abrasive article and the surface to abrade the surface.

15. A method of abrading a surface of a workpiece according to claim 14, wherein the first filter medium, second filter medium, and attachment interface member each comprise polypropylene.

16. A method of making an abrasive article, the method comprising:

providing an apertured coated abrasive member comprising abrasive particles secured to a first major surface of a thin flexible incompressible backing by make and size layers; and an adhesive layer adhered to a second major surface, opposite the first major surface, of the backing, wherein apertures extend through the abrasive layer, the backing, and the adhesive layer;

providing a first filter medium having a first surface and a second surface opposite the first surface, the first filter medium defining discrete channels formed by channel sidewalls, the discrete channels extending from the first surface of the first filter medium to the second surface of the first filter medium;

providing a second filter medium having first and second opposed surfaces;

providing an attachment interface member comprising fabric and having a back surface and an engageable surface opposed to the back surface;

contacting the first surface of the second filter medium with the second surface of the first filter medium;

contacting the back surface of the attachment interface member and the second surface of the second filter medium;

forming at least one weld joining the first filter medium, the second filter medium, and the attachment interface member, wherein the weld is situated at the second surface of the first medium; and adhering the adhesive layer of the apertured coated abrasive member to the first surface of the first filter medium, wherein at least a portion of the apertures cooperate with at least a portion of the discrete channels to allow a flow of particles from the apertured coated abrasive member to the second filter medium.

17. A method according to claim 16, wherein the first filter medium, the second filter medium, and the attachment interface member are joined together by a weld that comprises a continuous network of intersecting line segments.

18. A method according to claim 16, wherein the first filter medium, the second filter medium, and the attachment interface member are joined together by at least 20 welds.

19. A method according to claim 16, further comprising bonding the first filter medium to the second filter medium prior to joining the first filter medium, the second filter medium, and the attachment interface member.

20. A method according to claim 16, wherein the first filter medium, second filter medium, and attachment interface member each comprise polypropylene.

21. A method according to claim 16, wherein said at least one weld is formed by a process comprising:

contacting the first surface of the first filter medium with one of an ultrasonic welding horn or anvil, contacting the engageable surface of the attachment interface member with the other of the ultrasonic welding horn or anvil and ultrasonically forming at least one weld joining the first filter medium, the second filter medium, and the attachment interface member.

* * * * *